US008594518B2

(12) United States Patent
Burry et al.

(10) Patent No.: US 8,594,518 B2
(45) Date of Patent: Nov. 26, 2013

(54) DIAGNOSTIC METHOD FOR DETERMINING IMAGER CONTRIBUTION TO PRINTING DEFECTS

(75) Inventors: Aaron M. Burry, Ontario, NY (US); Eric S. Hamby, Webster, NY (US); Vladimir Kozitsky, Rochester, NY (US); Gary W. Skinner, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 311 days.

(21) Appl. No.: 13/108,287

(22) Filed: May 16, 2011

(65) Prior Publication Data

US 2012/0294631 A1 Nov. 22, 2012

(51) Int. Cl.
*G03G 15/00* (2006.01)

(52) U.S. Cl.
USPC ..... 399/15

(58) Field of Classification Search
USPC ..... 399/11, 10, 15
See application file for complete search history.

(56) References Cited

U.S. PATENT DOCUMENTS

| | | | | |
|---|---|---|---|---|
| 5,436,705 | A | 7/1995 | Raj | |
| 5,784,667 | A | 7/1998 | Mestha et al. | |
| 5,946,521 | A | 8/1999 | Budnik et al. | |
| 6,032,004 | A | 2/2000 | Mirabella, Jr. et al. | |
| 8,059,318 | B2 * | 11/2011 | Maebashi et al. | 399/15 |
| 2007/0201097 | A1 | 8/2007 | Anderson et al. | |
| 2010/0134858 | A1 | 6/2010 | Minamino et al. | |
| 2011/0019245 | A1 | 1/2011 | Adachi | |

FOREIGN PATENT DOCUMENTS

| | | |
|---|---|---|
| JP | 63031355 | 2/1988 |
| JP | 2008026623 | 2/2008 |

* cited by examiner

*Primary Examiner* — Susan Lee
(74) *Attorney, Agent, or Firm* — Gibb & Riley, LLC

(57) ABSTRACT

A method and device detect printing defects on prints produced by an electrostatic printing device and, in response, place the electrostatic printing device into a diagnostic mode. While in the diagnostic mode, the method and device charge an image bearing surface of the electrostatic printing device to a uniform potential charge and disable all light emitting devices of the electrostatic printing device that could alter the uniform potential charge. Next, this method and device transfer marking material to the image bearing surface to create a test image and print at least one test patch by transferring the test image from the image bearing surface to a sheet of media. This method and device evaluate whether the test patch includes the printing defects and identify whether the light emitting devices of the electrostatic printing device are defective, based on whether the test patch includes printing defects.

20 Claims, 5 Drawing Sheets

DIAGNOSTIC METHOD FOR DETERMINING IMAGER CONTRIBUTION TO PRINTING DEFECTS

BACKGROUND

Embodiments herein generally relate to printer diagnostics, and more particularly to methods and devices that detect printing defects on prints produced by an electrostatic printing device by placing the electrostatic printing device into a diagnostic mode.

In an effort to reduce post-sale maintenance costs, many companies are actively pursuing methodologies that would enable more diagnostic capability at the device. With smarter diagnostics on the device, the customer would in fact be able to accurately identify the source of the observed failure mode and, in some instances, even perform the required maintenance action.

SUMMARY

An exemplary method herein detects printing defects on prints produced by an electrostatic printing device and, in response, places the electrostatic printing device into a diagnostic mode. While in the diagnostic mode, this exemplary method charges an image bearing surface of the electrostatic printing device to a uniform potential charge and disables all light emitting devices of the electrostatic printing device that could alter the uniform potential charge. Next, this method transfers marking material to the image bearing surface to create a test image and prints at least one test patch by transferring the test image from the image bearing surface to a sheet of media.

The test image comprises a contone image. When the method prints the test image from the computerized storage device, it bypasses the light emitting devices.

This method evaluates whether the test patch includes the printing defects and identifies whether the light emitting devices of the electrostatic printing device is defective, based on whether the test patch includes printing defects. The evaluation process can comprise manual evaluation by the user making visual comparisons, or an automated evaluation utilizing scanners of the electrostatic printing device.

More specifically, if the test patch does not include the printing defects, the method identifies that the light emitting devices of the electrostatic printing device is a cause of the printing defects. If the test patch does include the printing defects, the method identifies that the light emitting devices of the electrostatic printing device is not a cause of the printing defects.

The method provides different maintenance and repair instructions on a graphic user interface of the electrostatic printing device depending upon whether the light emitting devices are defective or whether other components are defective.

An exemplary electrostatic printing device embodiment herein includes various components that are operatively connected to one another (when an item is "operatively connected" to another, it is directly or indirectly connected either physically, electronically, wirelessly, etc.). In this exemplary electrostatic printing device at least one image bearing surface is connected to a processor, at least one light emitting device is positioned adjacent the image bearing surface. The light emitting device is capable of altering the uniform potential charge.

Additionally, at least one marking material reservoir is adjacent the image bearing surface and supplies marking material to the image bearing surface. Further, at least one media supply supplies sheets of media to the image bearing surface. The processor places the electrostatic printing device into a diagnostic mode under instructions received through the graphic user interface. The processor charges the image bearing surface to a uniform potential charge (contone image) and disables the light emitting device while in the diagnostic mode. The marking material reservoir transfers the marking material to the image bearing surface to create a test image and the image bearing surface prints at least one test patch by transferring the test image to a sheet of media.

The graphic user interface receives input of whether the test patch includes printing defects. Alternatively scanners can be operatively connected to the processor, and the processor can evaluate whether the test patch includes the printing defects utilizing the scanners. The processor identifies whether the light emitting devices of the electrostatic printing device is defective, based on whether the test patch includes printing defects. Further, the processor can provide different maintenance and repair instructions on the graphic user interface of the electrostatic printing device depending upon whether the light emitting devices are defective.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
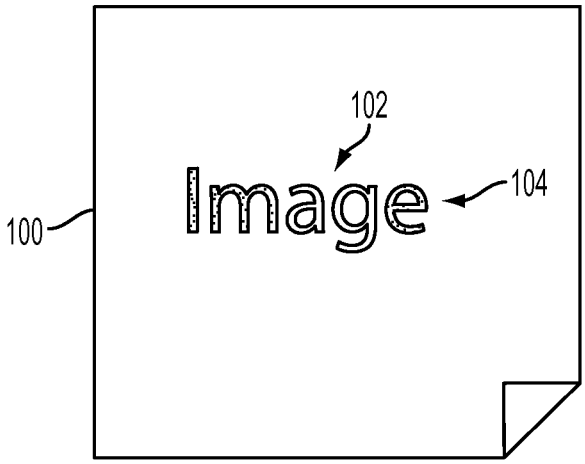
FIG. 1 is a top-view schematic diagram of a media sheet having printing defects.

Streaks are one example of image quality failure modes produced by printing machines. FIG. 1 illustrates a sheet of media 100 including a printed image 104 that has a printing defect 102 where some letters are formed incompletely and could be streaked. There are a number of possible sources within the print engine for streaks in the output prints. In some cases, the streak source can be identified based on the characteristics of the streak defect—sharp, blurry, wide, narrow, etc. However, in many cases this information is still insufficient to resolve the failure source ambiguity. A key example of this ambiguity is discerning streak artifacts coming from the developer housing (contamination or magnetic roller issues) or from contamination of the raster output scanner (ROS) window. Both sources can create streaks with similar characteristics, but require completely different maintenance actions to resolve. In view of this, and the embodiments herein provide a message, device, and computer program for accurately identifying whether streaks are coming from the developer housing or the ROS.

The embodiments herein provide a diagnostic method that places the printer into a special operating mode in order to identify whether an observed streak artifact is contributed by the imager (sometimes referred to herein as "light emitting devices," such as a ROS or light emitting diode (LED) bar). More specifically, by printing a solid but intentionally reducing development field (i.e. printing a contone patch) the imager can be taken completely out of the equation. By reducing the development field when creating this test patch, the ability to observe/measure streaks in the patch is greatly improved (it is typically difficult to see streaks in a solid).

Figure 2:
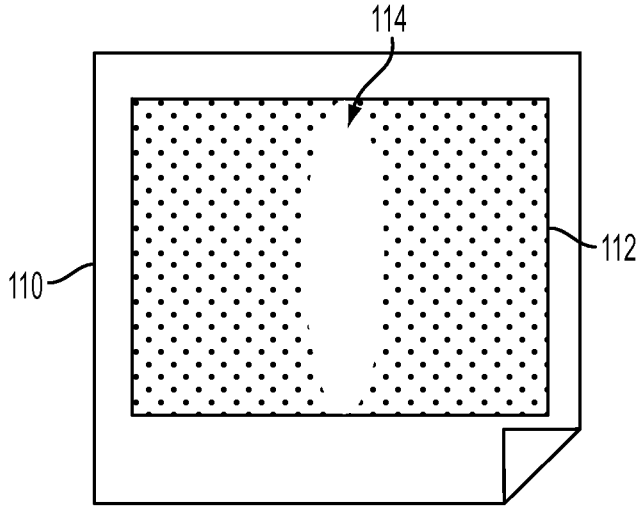
FIG. 2 is a top-view schematic diagram of a media sheet having test patches thereon according to embodiments herein.

For example, FIG. 2 illustrates a test patch 112 on a sheet of media 110 having a streak printing defect 114. If the streak 114 (artifact of interest) was not present in the test patch 112, then the imager was the most likely error source. These methods enable a very critical split to be made—that between the imager and other elements of the printing process. This is a key split since the artifacts contributed by the imager can typically be resolved through customer action—cleaning a ROS window, initiating a recalibration of the LED bar uniformity, etc. Enabling this type of customer intervention saves money by preventing the dispatch of a service technician for conditions that were in fact customer fixable.

There are a number of methods that can be used to detect whether or not the streaks are in fact present in both the normal and contone print modes. First, the test patches can be presented to the customer and the customer can be asked to identify whether or not the artifact of interest 102 is present in the normal image 104 and the test patch 112.

Embodiments herein also present automated methods of identification. In one, test patches are created in both modes and the customer scans them on the platen. In others, internal sensors scan the sheets before they exit the printer. Streak profiles (mean of the image in the process direction) are then created for each test patch. Simulations of streak profiles from such scans are given in FIG. 3-4.

Figure 3:
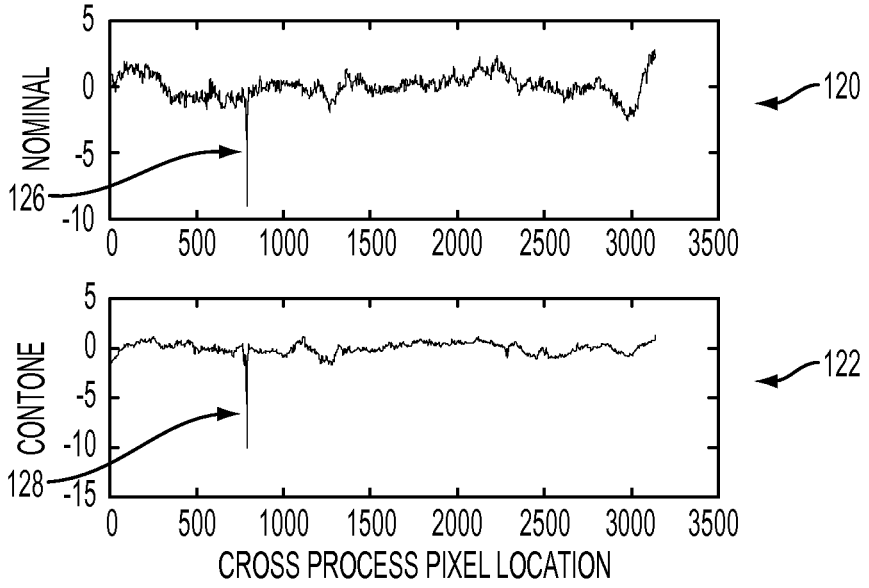
FIG. 3 is a chart illustrating printing defects according to embodiments herein.
Figure 4:
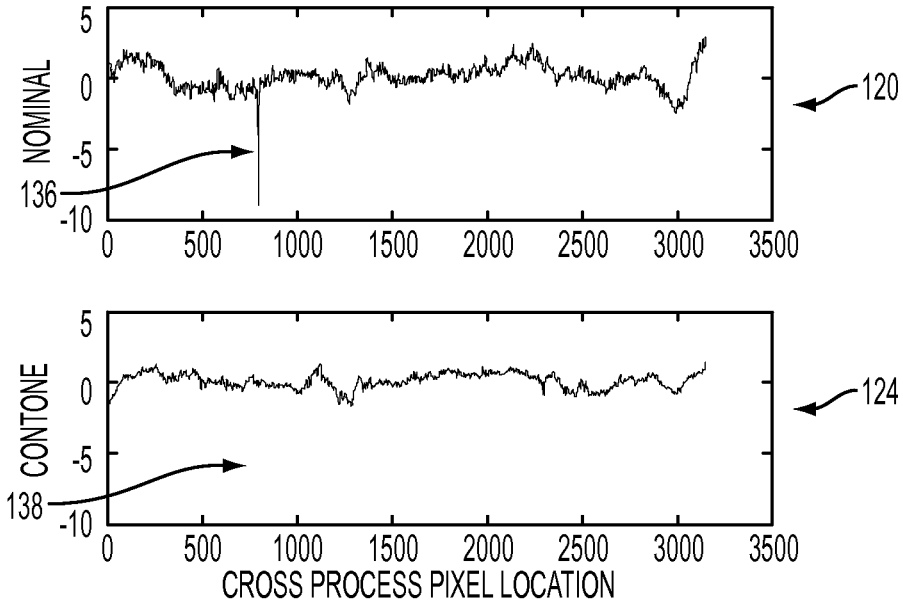
FIG. 4 is a chart illustrating printing defects according to embodiments herein.

More specifically, as shown in FIG. 3, graph 120 illustrates the detection of the artifact 102 within the normal (non-test, non-diagnostic mode) printed sheet 100 at point 126 in the graph. Graph 122 in FIG. 3 illustrates a corresponding defect 128 within the diagnostic mode print, indicating that the source of the defect is not within the imager, but instead is within some other component of the electrostatic printing device. To the contrary, as shown in FIG. 4, the same graph 120 is repeated for reference; however, in the diagnostic mode graph 124, there is no artifact (indicated by arrow 138 in FIG. 4) indicating that the defect is caused somewhere within the scanner or imager (ROS, LED, etc.)

The embodiments herein also use correlations between the streak profiles created and scanned in both modes to automatically indicate the likelihood that the streak artifacts 102 are being caused by the imager. In one exemplary implementation, if the correlation values exceed a pre-defined threshold, then the imager can be ruled out as the source of the observed failure mode. In alternate embodiments, the results of these measurements are supplied to a Bayesian analysis engine or the data is treated as "health state" information and is used to modify the prior probability of failure for the imager in the Bayesian system. Finally, by tracking the evolution of the correlation between the contone and normal mode streak profiles, the embodiments herein identify slow drift of imager performance over time. This information is used by embodiments herein to suggest mitigating actions prior to artifacts appearing in customer prints.

Figure 5:
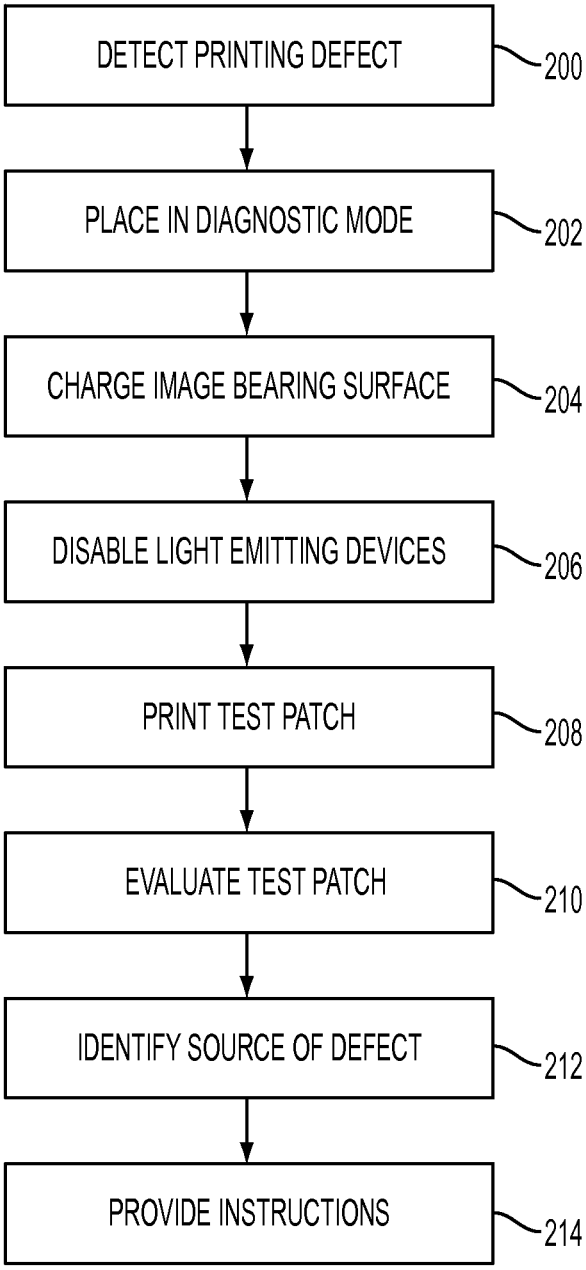
FIG. 5 is a flow diagram illustrating various embodiments herein.

FIG. 5 is flowchart illustrating an exemplary method herein. In item 200, this method detects printing defects on prints produced by an electrostatic printing device and, in response, places the electrostatic printing device into a diagnostic mode in item 202. While in the diagnostic mode, in item 204, this exemplary method charges an image bearing surface of the electrostatic printing device to a uniform potential charge to create a contone image and, in item 206, disables all light emitting devices of the electrostatic printing device that could alter the uniform potential charge. Next, this method transfers marking material to the image bearing surface to create a test image and prints at least one test patch by transferring the test image from the image bearing surface to a sheet of media in item 208. The test image comprises a contone image. When the method prints the test image in item 208, it bypasses the light emitting devices.

This method then evaluates whether the test patch includes the printing defects in item 210 and identifies whether the light emitting devices of the electrostatic printing device is defective, based on whether the test patch includes printing defects in item 212. The evaluation process 212 can comprise manual evaluation by the user making visual comparisons, or an automated evaluation utilizing scanners of the electrostatic printing device.

More specifically, in item 212 if the test patch does not include the printing defects, the method identifies that the light emitting devices of the electrostatic printing device is a cause of the printing defects. If the test patch does include the printing defects, the method identifies that the light emitting devices of the electrostatic printing device is not a cause of the printing defects. In item 214, the method provides different maintenance and repair instructions on a graphic user interface of the electrostatic printing device depending upon whether the light emitting devices are defective or whether other components are defective.

Figure 6:
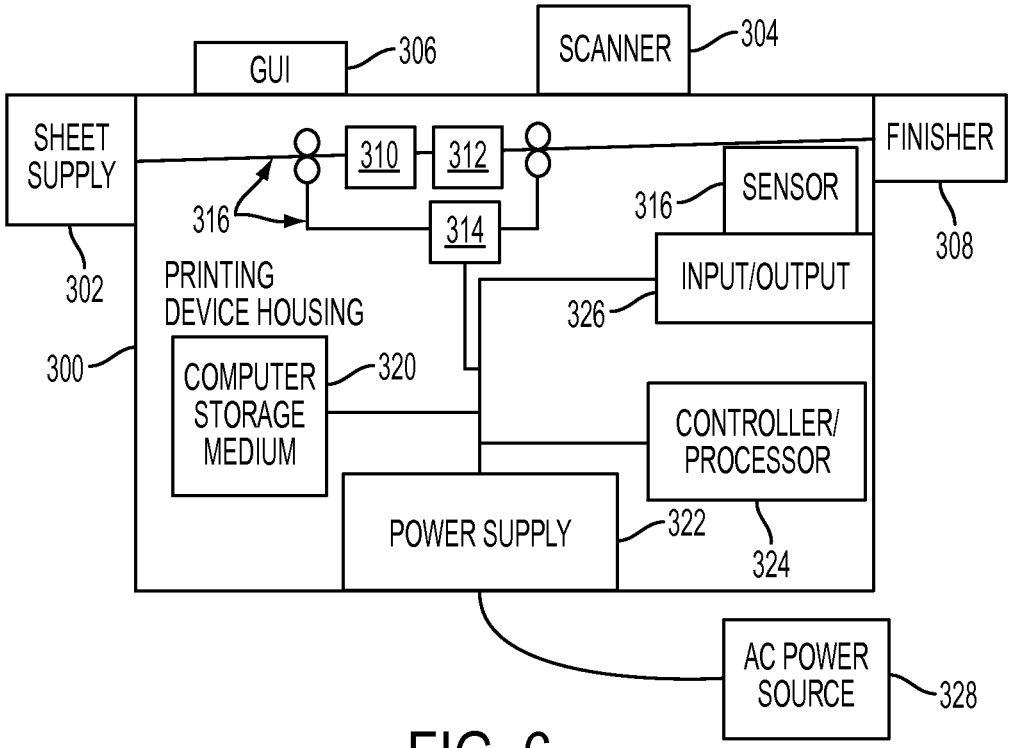
FIG. 6 is a side-view schematic diagram of an electrostatic printing device according to embodiments herein.

An exemplary electrostatic printing device embodiment herein includes various components that are operatively connected to one another (when an item is "operatively connected" to another, it is directly or indirectly connected either physically, electronically, wirelessly, etc.). FIG. 6 illustrates a computerized electrostatic printing device 300, which can be used with embodiments herein and can comprise, for example, a printer, copier, multi-function machine, etc. The electrostatic printing device 300 includes a controller/processor 324, at least one marking device (printing engines) 310, 312, 314 operatively connected to the processor 324, a media path 316 positioned to supply sheets of media from a sheet supply 302 to the marking device(s) 310, 312, 314, and a communications port (input/output) 326 operatively connected to the processor 324 and to a computerized network external to the electrostatic printing device. After receiving various markings from the printing engine(s), the sheets of media can optionally pass to a finisher 308 which can fold, staple, sort, etc., the various printed sheets.

Also, the electrostatic printing device 300 can include at least one accessory functional component (such as a scanner/document handler 304, sheet supply 302, finisher 308, etc.) and graphic user interface assembly 306 that also operate on the power supplied from the external power source 328 (through the power supply 322).

The input/output device 326 is used for communications to and from the multi-function electrostatic printing device 300. The processor 324 controls the various actions of the electrostatic printing device. A non-transitory computer storage medium device 320 (which can be optical, magnetic, capacitor based, etc.) is readable by the processor 324 and stores instructions that the processor 324 executes to allow the multi-function electrostatic printing device to perform its various functions, such as those described herein.

Thus, a printer body housing 300 has one or more functional components that operate on power supplied from the alternating current (AC) 328 by the power supply 322. The power supply 322 connects to an external alternating current power source 328 and converts the external power into the type of power needed by the various components.

Figure 7:
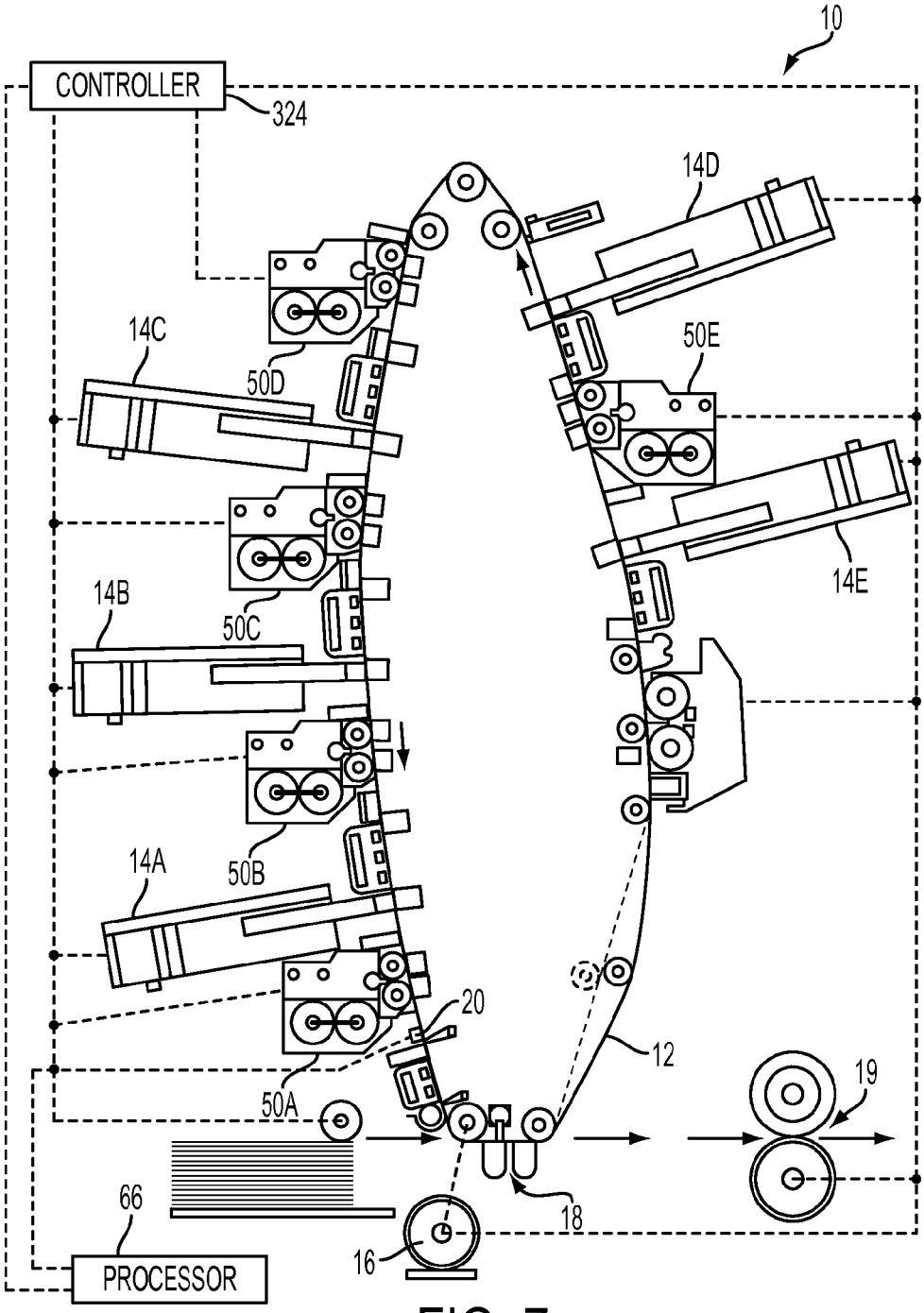
FIG. 7 is a side-view schematic diagram of an electrostatic printing device according to embodiments herein.

FIG. 7 schematically illustrates a more detailed aspect of a portion of a printing device 10, such as one or more of the marking engines 310, 312, 314 shown in FIG. 6. The printer generally uses a raster output scanner (ROS) or LED bar to expose the charged portions of an image bearing surface and to record an electrostatic latent image on the image bearing surface.

All operations and functions may be controlled by programmed microprocessors, as described above, at centralized, distributed, or remote system-server locations, any of which are schematically illustrated here by the controller/processor 324, 66. A single image bearing surface 12 may be successively charged, ROS imaged, and developed with black or any or all primary colors toners by a plurality of imaging stations. In this example, these plural imaging stations include respective ROS's 14A, 14B, 14C, 14D, and 14E; and associated developer units 50A, 50B, 50C, 50D, and 50E. In FIG. 5, a five-color version of the image printing system is shown. A composite plural color imaged area may be formed in each desired image area in a single revolution of the image bearing surface 12 with this exemplary printer 10. A linear array sensor 20 is schematically illustrated, and will be further described herein concerning such registration.

The image bearing surface 12 can be a photoreceptor drum, a photoreceptor belt, an intermediate transfer belt, an intermediate transfer drum, or other image bearing surfaces. That is, the term image bearing surface means any surface on which a toner image is received, and this may be an intermediate surface (i.e., a drum or belt on which an image is formed prior to transfer to the printed document). In one embodiment, the image bearing surface 12 may include a conventional drive system 16 for moving the image bearing surface 12 in the process direction shown by its movement arrows. A conventional transfer station 18 is illustrated for the transfer of the composite color images to the final substrate, usually a paper sheet, which then is fed to a fuser 19 and outputted.

As would be understood by those ordinarily skilled in the art, the electrostatic printing devices shown in FIGS. 6 and 7 and are only limited examples and the embodiments herein are equally applicable to other types of electrostatic printing devices that may include fewer components or more components. For example, while a limited number of printing engines and paper paths are illustrated, those ordinarily skilled in the art would understand that many more paper paths and additional printing engines could be included within an electrostatic printing device used with embodiments herein.

In such computerized (printing) devices 10, 300, the processor 324 places the electrostatic printing device 300 into a diagnostic mode under instructions received through the graphic user interface 306. The processor 324 charges the image bearing surface 12 to a uniform potential charge and disables the light emitting devices 14 while in the diagnostic mode. A marking material reservoir within developer units 50 transfers marking material (e.g., toner, ink, etc.) to the image bearing surface 12 to create a test image and the image bearing surface 12 prints at least one test patch by transferring the test image to a sheet of media.

The graphic user interface 306 receives input of whether the test patch includes printing defects from the user. Alternatively, internal or external scanners 316, 304 can be operatively connected to the processor 324, and the processor 324 can automatically evaluate whether the test patch includes the printing defects utilizing the scanners 316, 304. The processor 324 identifies whether the light emitting devices 300 of the electrostatic printing device 300 is defective, based on whether the test patch includes printing defects. Further, the processor 324 can provide different maintenance and repair instructions on the graphic user interface 306 of the electrostatic printing device 300 depending upon whether the light emitting devices 300 is defective.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or electrostatic printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A method comprising:

placing an electrostatic printing device into a diagnostic mode;

charging an image bearing surface of said electrostatic printing device to a uniform potential charge;

disabling all light emitting devices of said electrostatic printing device that could alter said uniform potential charge while in said diagnostic mode;

transferring marking material to said image bearing surface to create a test image;

printing at least one test patch by transferring said test image from said image bearing surface to a sheet of media;

evaluating whether said test patch includes printing defects; and identifying if said light emitting devices are defective, based on whether said test patch includes printing defects.

2. The method according to claim 1, said test image comprising a contone image.

3. The method according to claim 1, said printing of said test patch bypasses said light emitting devices.

4. The method according to claim 1, said evaluating comprising one of manual evaluation and automated evaluation utilizing scanners of said electrostatic printing device.

5. The method according to claim 1, further comprising providing different maintenance and repair instructions on a graphic user interface of said electrostatic printing device depending upon whether said light emitting devices are defective.

6. A method comprising:

detecting printing defects on prints produced by an electrostatic printing device;

placing said electrostatic printing device into a diagnostic mode in response to said printing defects on said prints;

charging an image bearing surface of said electrostatic printing device to a uniform potential charge;

disabling all light emitting devices of said electrostatic printing device that could alter said uniform potential charge while in said diagnostic mode;

transferring marking material to said image bearing surface to create a test image;

printing at least one test patch by transferring said test image from said image bearing surface to a sheet of media;

evaluating whether said test patch includes said printing defects;

if said test patch does not include said printing defects, identifying that said light emitting devices of said electrostatic printing device are a cause of said printing defects; and if said test patch does include said printing defects, identifying that said image bearing surface of said electrostatic printing device is a cause of said printing defects.

7. The method according to claim 6, said test image comprising a contone image.

8. The method according to claim 6, said printing of said test patch bypasses said light emitting devices.

9. The method according to claim 6, said evaluating comprising one of manual evaluation and automated evaluation utilizing scanners of said electrostatic printing device.

10. The method according to claim 6, further comprising providing different maintenance and repair instructions on a graphic user interface of said electrostatic printing device depending upon whether said light emitting devices are defective.

11. An electrostatic printing device comprising:

at least one processor;

at least one graphic user interface operatively connected to said processor;

at least one image bearing surface operatively connected to said processor;

at least one light emitting device operatively connected to said processor and positioned adjacent said image bearing surface;

at least one marking material reservoir adjacent said image bearing surface and supplying marking material to said image bearing surface; and at least one media supply supplying sheets of media to said image bearing surface, said processor placing said electrostatic printing device into a diagnostic mode under instructions received through said graphic user interface, said processor charging said image bearing surface to a uniform potential charge, said light emitting device being capable of altering said uniform potential charge;

said processor disabling said light emitting device while in said diagnostic mode;

said marking material reservoir transferring said marking material to said image bearing surface to create a test image;

said image bearing surface printing at least one test patch by transferring said test image to a sheet of media;

said graphic user interface receiving input of whether said test patch includes printing defects; and said processor identifying whether said light emitting devices is defective, based on whether said test patch includes printing defects.

12. The electrostatic printing device according to claim 11, said test image comprising a contone image.

13. The electrostatic printing device according to claim 11, said printing of said test patch bypasses said light emitting devices.

14. The electrostatic printing device according to claim 11, further comprising scanners operatively connected to said processor, said processor evaluating whether said test patch includes said printing defects.

15. The electrostatic printing device according to claim 11, said processor providing different maintenance and repair instructions on said graphic user interface of said electrostatic printing device depending upon whether said light emitting devices are defective.

16. A non-transitory computer-readable storage device comprising a non-volatile computer storage medium storing instructions executable by a computer, said instruction causing said computer to perform a method comprising:

placing an electrostatic printing device into a diagnostic mode;

charging an image bearing surface of said electrostatic printing device to a uniform potential charge;

disabling all light emitting devices of said electrostatic printing device that could alter said uniform potential charge while in said diagnostic mode;

transferring marking material to said image bearing surface to create a test image;

printing at least one test patch by transferring said test image from said image bearing surface to a sheet of media;

evaluating whether said test patch includes printing defects; and identifying if said light emitting devices are defective, based on whether said test patch includes printing defects.

17. The non-transitory computer-readable storage device according to claim 16, said test image comprising a contone image.

18. The non-transitory computer-readable storage device according to claim 16, said printing of said test patch bypasses said light emitting devices.

19. The non-transitory computer-readable storage device according to claim 16, said evaluating comprising one of manual evaluation and automated evaluation utilizing scanners of said electrostatic printing device.

20. The non-transitory computer-readable storage device according to claim 16, said method further comprising providing different maintenance and repair instructions on a graphic user interface of said electrostatic printing device depending upon whether said light emitting devices are defective.

* * * * *